US007339582B2

(12) United States Patent
Akahori

(10) Patent No.: US 7,339,582 B2
(45) Date of Patent: Mar. 4, 2008

(54) DISPLAY DEVICE INCLUDING A PLURALITY OF CASCADE-CONNECTED DRIVER ICS

(75) Inventor: Hideki Akahori, Kanagawa (JP)

(73) Assignee: NEC Electronics Corportion (JP)

( * ) Notice: Subject to any disclaimer, the term of this patent is extended or adjusted under 35 U.S.C. 154(b) by 804 days.

(21) Appl. No.: 10/769,319

(22) Filed: Jan. 29, 2004

(65) Prior Publication Data

US 2005/0012705 A1 Jan. 20, 2005

(30) Foreign Application Priority Data

Jan. 29, 2003 (JP) ..... 2003-021079

(51) Int. Cl.
*G09G 5/00* (2006.01)

(52) U.S. Cl. ..... 345/213; 345/87; 345/204

(58) Field of Classification Search ..... 345/87–90, 345/94–100, 204–205, 208–214; 327/94–96, 327/100, 149, 427
See application file for complete search history.

(56) References Cited

U.S. PATENT DOCUMENTS

| | | | | |
|---|---|---|---|---|
| 6,211,849 | B1 * | 4/2001 | Sasaki et al. | 345/55 |
| 7,075,505 | B2 * | 7/2006 | Sakaguchi et al. | 345/87 |
| 2001/0013850 | A1 | 8/2001 | Sakaguchi et al. | |
| 2002/0038396 | A1 * | 3/2002 | Kanzaki et al. | 710/100 |

FOREIGN PATENT DOCUMENTS

| | | |
|---|---|---|
| JP | 4-245291 | 9/1992 |
| JP | 5-204328 | 8/1993 |
| JP | 8-10166 | 4/1996 |
| JP | 9-36759 | 2/1997 |
| JP | 10-63218 | 3/1998 |
| JP | 10-153760 | 6/1998 |
| JP | 11-194748 | 7/1999 |
| JP | 2001-202052 | 7/2001 |
| JP | 2001-265291 | 9/2001 |
| JP | 2002-23710 | 1/2002 |
| JP | 2002-55663 | 2/2002 |

OTHER PUBLICATIONS

Untranslated Office Action issued by Japanese Patent Office on Nov. 22, 2005 in in connection with corresponding Japanese application No. 2003-021079.
English translation of Japanese Office Action dated Nov. 22, 2005 issued in connection with corresponding Japanese application No. 2003-021079.
Untranslated Office Action issued by Korean Patent Office on Nov. 30, 2005 in in connection with correponding Korean application No. 10-2004-0005271.

* cited by examiner

*Primary Examiner*—Richard Hjerpe
*Assistant Examiner*—Mansour M. Said
(74) *Attorney, Agent, or Firm*—Ostrolenk, Faber, Gerb & Soffen, LLP

(57) ABSTRACT

A display device disclosed herein prevents timing misalignment between signals of clock, data, and start pulses to be supplied to driver ICs. The display device comprises a controller, driver ICs and other components and each driver IC is configured to receive clock, data, and start pulses output from the controller, supply the received clock, data, and start pulses to a switch through parallel paths without routing the signals through its internal circuit, and supply the received clock, data, and start pulses to output terminals via the switch.

9 Claims, 12 Drawing Sheets

DISPLAY DEVICE INCLUDING A PLURALITY OF CASCADE-CONNECTED DRIVER ICS

BACKGROUND OF THE INVENTION

1. Field of the Invention

The present invention relates to a display device and, more particularly, to a display device including a plurality of driver ICs that are cascade connected.

2. Description of Related Art

Display panels have lately become even larger and a display device that is driven by a plurality of cascade-connected driver ICs draws attention.

Such a display device which is typically configured in prior art as is shown in FIG. 12 is generally known (for example, refer to Japanese Patent Document Cited 1).

The display device shown in FIG. 12 comprises an LCD controller which outputs start pulses, visual data, and a clock and a plurality of driver ICs, each of which captures visual data synchronized with a clock in response to a start pulse and drives a display panel, based on the visual data.

A driver IC starts to capture data in response to a start pulse supplied from the LCD controller and captures the data in synchronization with a clock signal. Upon completion of capturing the data, the driver IC outputs a start pulse to the next driver IC.

In this manner, one driver IC generates a start pulse to the next stage driver IC, and the plurality of driver ICs capture data sequentially and drive the display panel.

[Japanese Patent Document Cited 1]

Japanese Published Unexamined Patent Application No. Hei 11-194748

In the liquid crystal display device shown as a prior art example, data, a clock, and a start signal are supplied to a first-stage deriver IC from the LCD controller, wherein the start signal is supplied to the first-stage driver only once for one horizontal period, whereas, to second-stage and subsequent driver ICs, the data and clock are supplied from the LCD controller and a start signal is supplied from the preceding-stage driver IC. Thus, the second-stage and subsequent driver ICs capture data, synchronized with the clock signal and based on the start signal generated by the preceding-stage driver IC. For the second-stage and subsequent driver ICs, the data and clock are synchronized because their transmission paths are substantially the same, but the data/clock and the start signal which is generated by a driver internal circuit are not synchronized. This causes a problem that erroneous data is captured when timing misalignment between the data/clock and the start signal occurs. This problem is significant at higher clock frequencies.

SUMMARY OF THE INVENTION

It is therefore an object of the present invention to provide a display device in which start signals to be supplied to the driver ICs are synchronized with data and clock pulses to enable the data supplied from the LCD controller to be captured without fail.

A display device of the present invention comprises a controller which outputs start pulses, data, and a clock and a plurality of drivers which are cascade connected, each of the plurality of drivers comprising a start pulse input terminal for receiving the start pulses, a data input terminal for receiving the data, a clock input terminal for receiving the clock, a start pulse output terminal for outputting the start pulses received, a data output terminal for outputting the data received, a clock output terminal for outputting the clock received, and an internal circuit which captures the data that has been input in response to one of the start pulses in synchronization with the clock.

In this configuration, the start pulses, data, and clock are received by one driver and passed through the driver to the next-stage driver, therefore, the signals are transmitted through parallel paths, and phase misalignment is reduced.

DETAILED DESCRIPTION OF THE PREFERRED EMBODIMENTS

Preferred embodiments of the present invention will be described hereinafter with reference to the accompanying drawings. The invention will be described more specifically through its illustrative embodiments.

Figure 1:
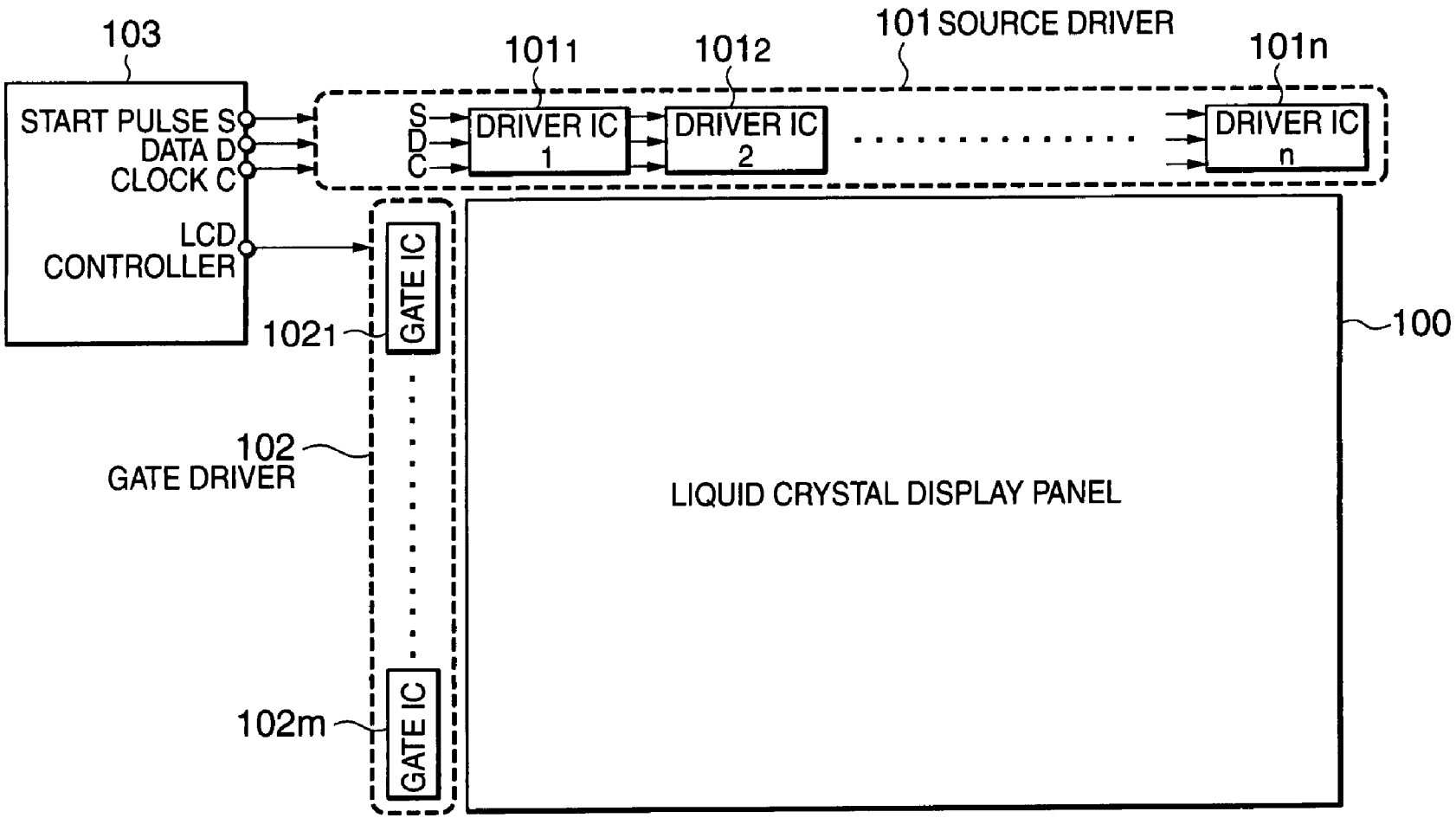
FIG. 1 is a system diagram of a display device of the present invention.

A preferred Embodiment 1 of the present invention is discussed, referring to FIG. 1.

A system comprising a display device of the present invention is made up of a display panel 100 such as a liquid crystal or plasma display, a source driver 101 which supplies pixel data to the display panel 100, a gate driver 102 which drives the gates of pixels to be scanned by one horizontal scan line on the display panel 100 and supplies the data from the source driver 101 to the pixels, and a controller 103 which supplies a start pulse S, data D, and a clock C to the source driver 101 and supplies a scan horizontal sync signal and the like to the gate driver 102.

The source driver 101 consists of cascade-connected driver ICs 1011 to 101*n*. A driver IC 1011 receives a start pulse S, data D, and a clock C from the controller 103, transmits these signals to a driver IC 1012, and the driver IC 1012 and subseqent driver ICs receive these signals from the preceding-stage driver and supply the signals to the following-stage driver IC and eventually the driver IC 101*n* receives these signals.

Figure 2:
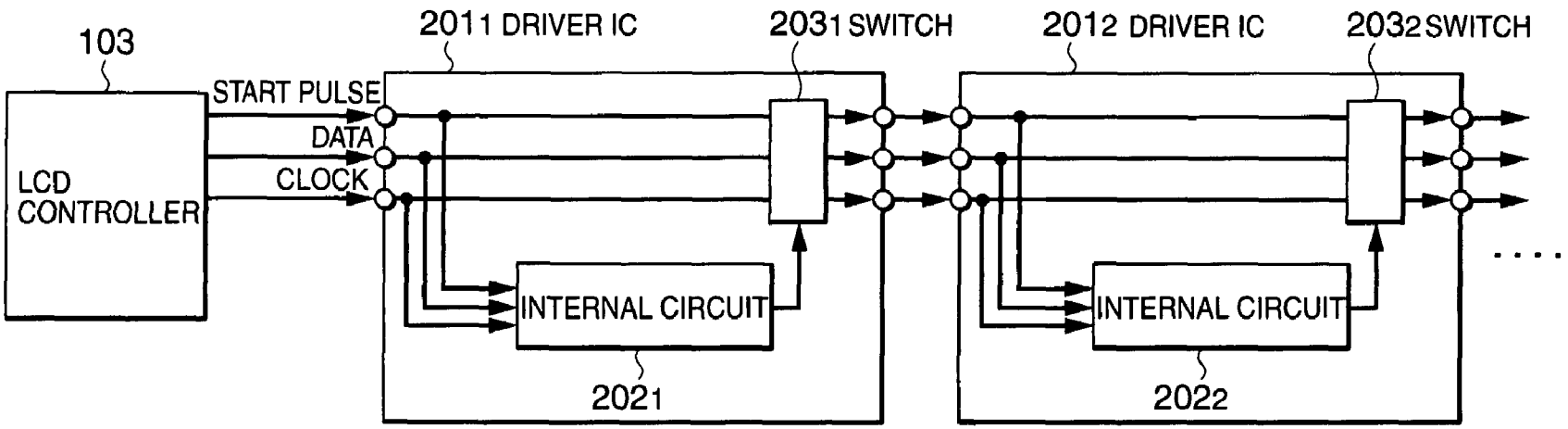
FIG. 2 is a diagram depicting Embodiment 1 of the present invention.

The driver IC 2011, as is shown in FIG. 2, comprises a start pulse input terminal for receiving a start pulse from the controller 103, a data input terminal for receiving data, a clock input terminal for receiving a clock, an internal circuit 2021, a switch 2031, a start pulse output terminal for outputting the start pulse to the next-stage driver 2012, a data output terminal for outputting the data, and an output terminal for outputting the clock.

The start pulse is transmitted from the start pulse input terminal to the start pulse output terminal, the data is transmitted from the data input terminal to the data output terminal, and the clock is transmitted from the clock input terminal to the clock output terminal through internal wiring of the driver IC and the switch 2031. Note that all these signals are not routed through the internal circuit 2021 to the output terminals. Thus, the start pulse and the data/clock do not fall out of sync, which could take place in a similar prior-art device because the start pulse is supplied on a different path from the transmission paths of the data/clock in the prior-art device. The reliability in data capturing is enhanced and the driver ICs robust to high clock frequencies can be realized.

Then, how the display device of Embodiment 1 operates is discussed.

Figure 3:
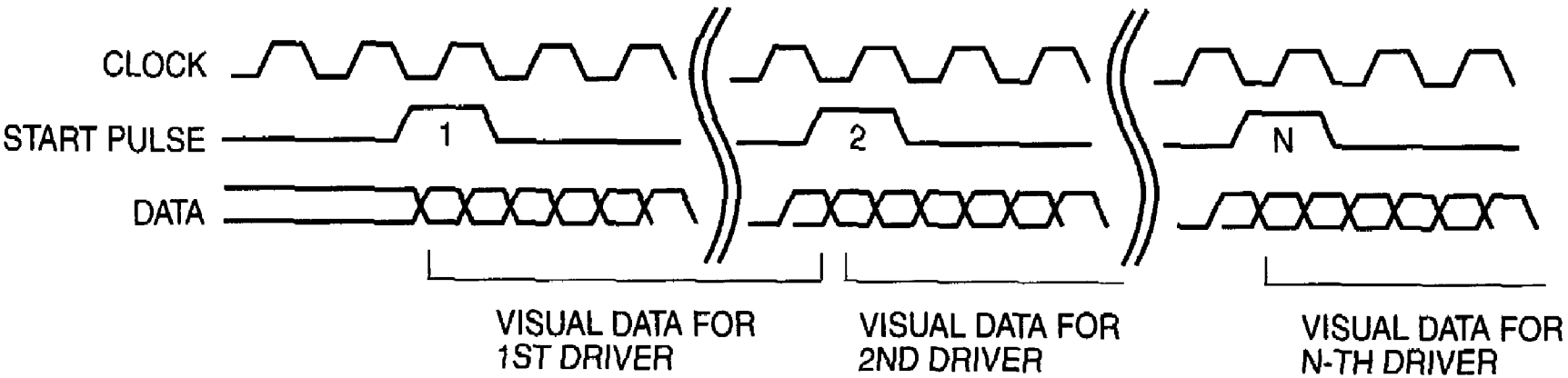
FIG. 3 a timing chart of signals output from a controller in Embodiment 1.

The driver ICs do not generate a start pulse inside them as implied above. Therefore, start pulses to be transmitted to the driver ICs are generated by the controller 103 and supplied, as is shown in FIG. 3. If, for example, N pieces of driver ICs are cascade connected, the controller 103 generates N start pulses at given intervals.

Each driver IC captures data in response to a rising edge of a start pulse. More specifically, the data transmitted from the controller 103 to be captured in response to the rising and falling edges of clock pulses after the rise of the start pulse. Accordingly, the controller 103 outputs the clock C, data D, and start pulses S at timing as shown in FIG. 3. If a time margin is required until data is captured on the rising edge of a clock pulse after the rise of a start pulse (in the case of a high-rate clock), data may be captured on the rising edge of a clock pulse following first n clock pulses (n is 1 or more).

Figure 4:
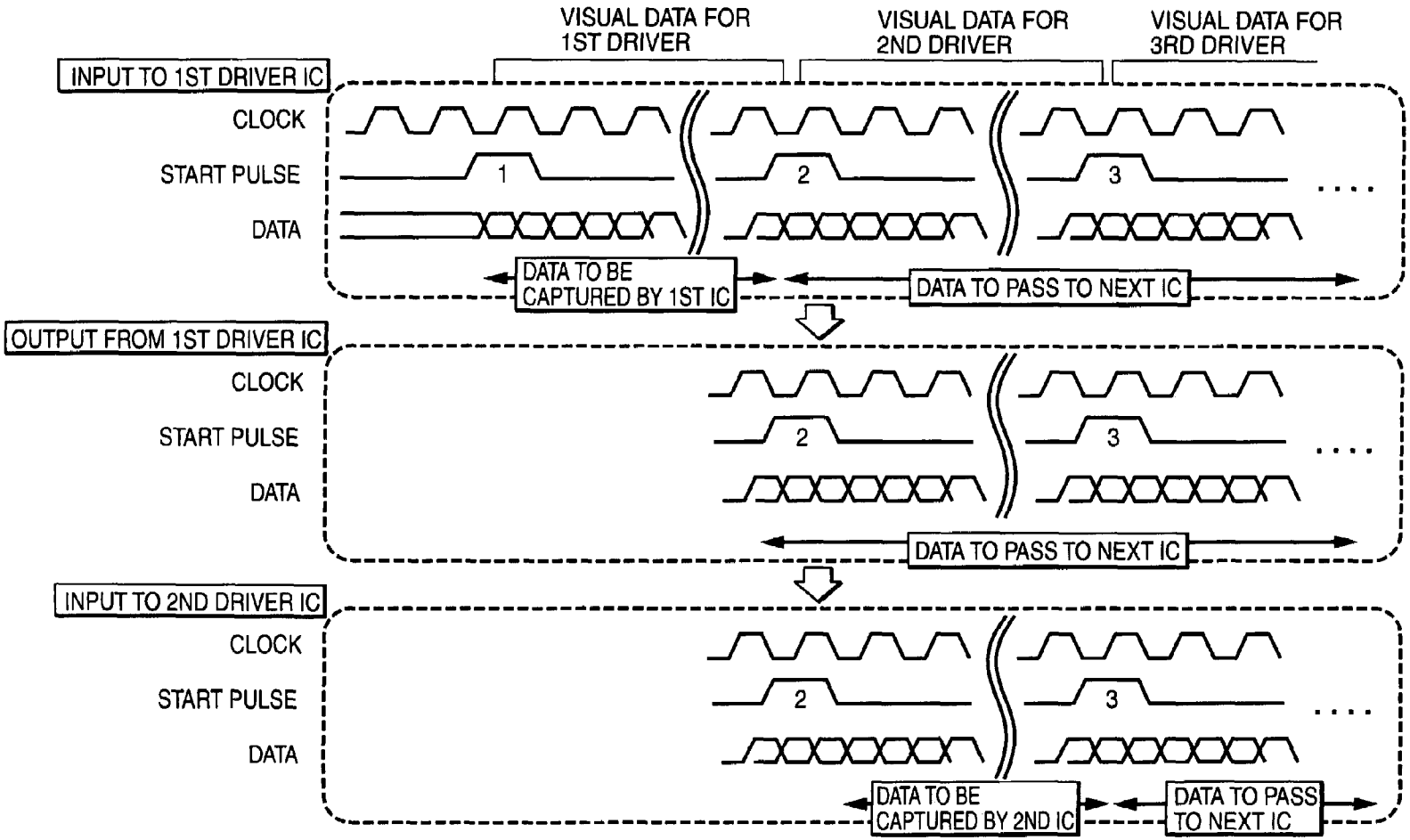
FIG. 4 is a timing chart of the signals at driver ICs in Embodiment 1.

The clock C, data D, and start pulses S output from the controller 103 are supplied to the clock input terminal, data input terminal, and start pulse input terminal of the first-stage driver IC 2011. The internal circuit 2021 of the driver IC 2011 captures the data in response to the first start pulse and in synchronization with the both edges of the clock pulses. At the same time, the input clock, data, and start pulses are transmitted to the switch 2031 without being routed through the internal circuit. Upon receiving the start pulse, the internal circuit 2021 captures the input data in response to the start pulse and in synchronization with the clock pulse edges, as is shown in FIG. 4, and outputs a control signal to activate the switch 2031 upon having captured a predetermined number of data. The control signal can be generated by a shift register, which is not shown, in the internal circuit 2021 at timing when the predetermined number of data has been captured. The control signal must be generated before the arrival of the next start pulse, preferably to activate the switch before several clocks earlier than the arrival of the next start pulse, including a time margin. Transmission of the start pulses, data, and clock is thus controlled by the switch 2031 and, consequently, the second start pulse, the data to be captured in response to the start pulse, and clock are supplied to the next-stage driver IC 2012, as shown in FIG. 4.

Figure 5:
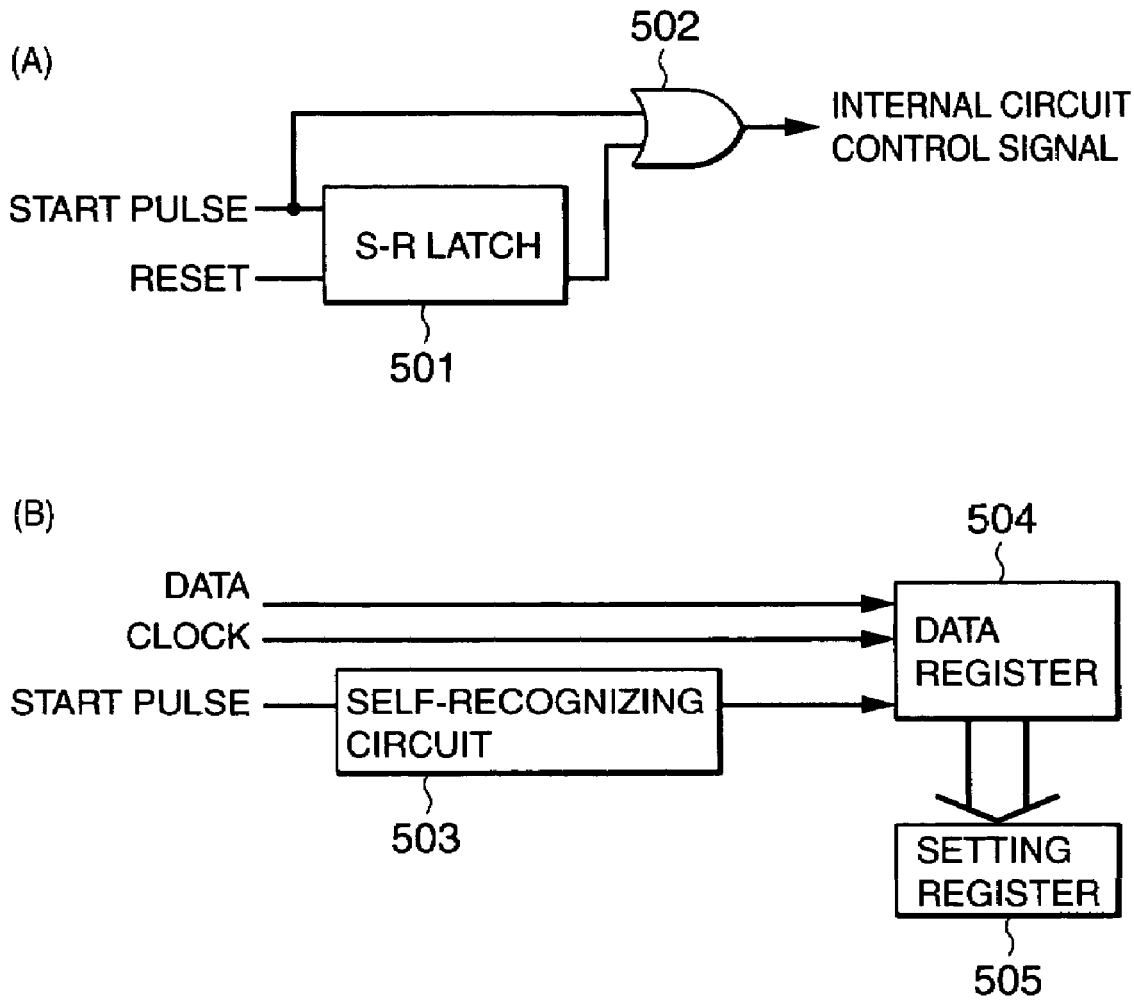
FIG. 5(A) shows an internal circuit control circuit.
FIG. 5(B) shows a setting data capturing circuit.

When the start pulse (second) is input, the first-stage driver IC 2011 has already received the data and, therefore, must be controlled not to be re-triggered by that start pulse. For this purpose, to control capturing the data into the internal circuit, a circuit that outputs an internal circuit control signal in response to the first input start pulse is required. Such a circuit can be formed of an S-R latch 501 which is set by the input of a start pulse and an OR gate 502 which receives the start pulse and the output of the S-R latch, performs logical OR, and outputs an internal circuit control signal, as is shown in FIG. 5(A). The OR gate 502 outputs a high level signal at timing when the start pulse has changed to a high level and the S-R latch 501 changes its output from a low level to a high level at timing when the start pulse has changed to a high level. As a result, the output of the S-R latch 501 that has been set keeps one input to the OR gate 502 locked to a high level until a reset signal is input and a constant high internal circuit control signal is supplied to the internal circuit during the high level state of the start pulse. Assuming that the internal circuit is configured to operate, according to the level change of the internal circuit control signal, the internal circuit can be controlled to capture data upon the first input start pulse and not to capture data upon the input of the next start pulse.

Figure 6:
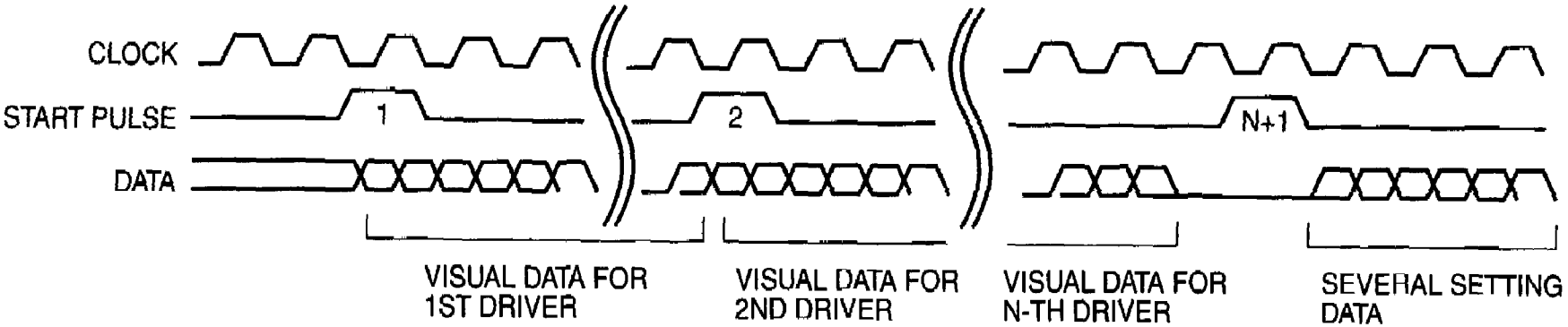
FIG. 6 is a timing chart of the signals including setting data output from the controller in Embodiment 1.
Figure 7:
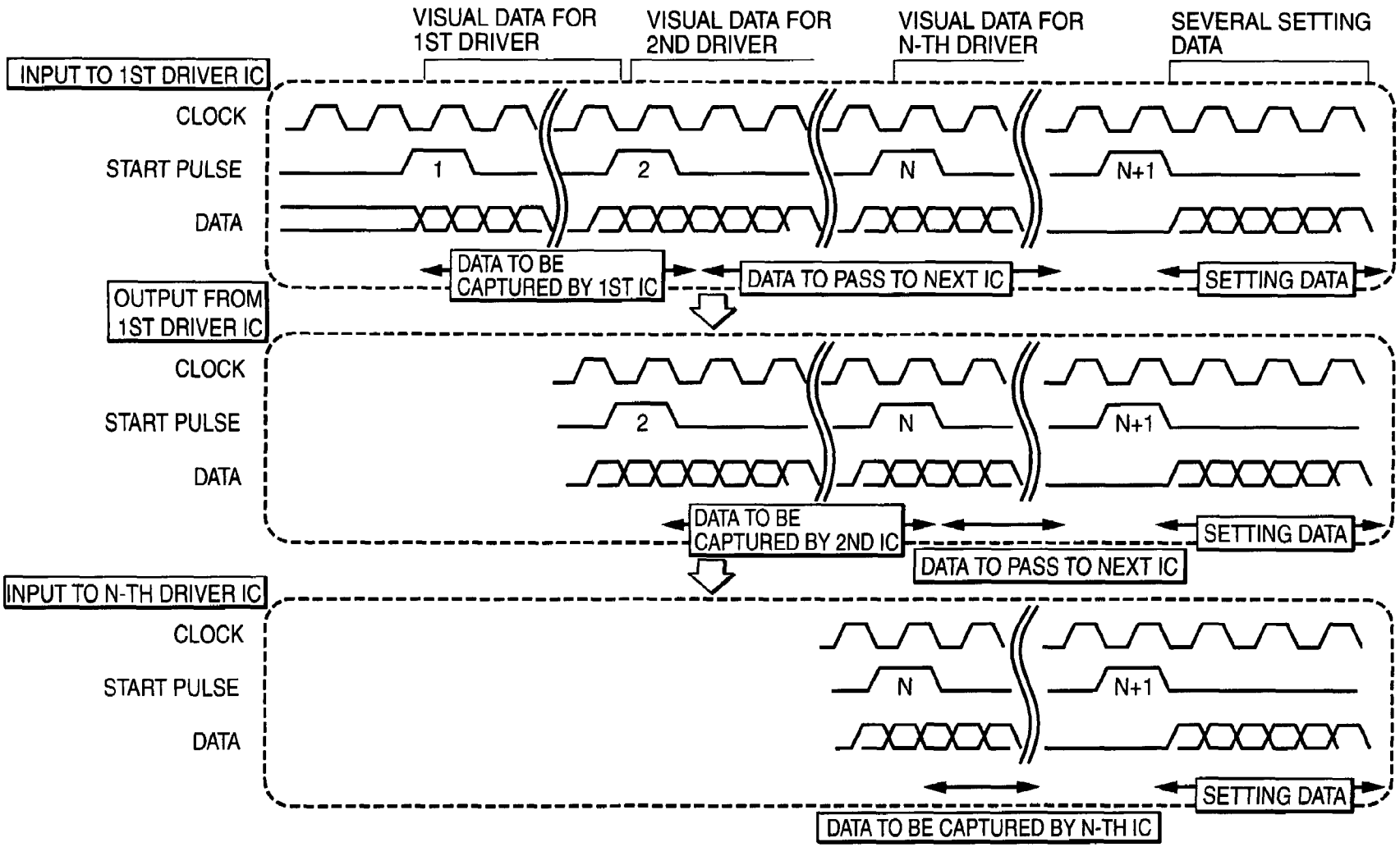
FIG. 7 is a timing chart of the signals at the driver ICs in Embodiment 1.

Further, by using a self-recognizing circuit 503 and a data register 504, as is shown in FIG. 5(B), setting data added to the data can be read into a setting register 505 included on each driver IC. Start pulses are input to the self-recognizing circuit 503. In this example where the N pieces of driver ICs are cascade connected, as described above, N pieces of start pulses are input to the first-stage driver IC, N−1 pieces of start pulses are input to the second-stage driver ICs, and so on, and one start pulse is input to the Nth-stage driver IC. Therefore, by the number of start pulses counted by the self-recognizing circuit 503, each driver IC can recognize one of the n stages in which it is positioned in the chain. Accordingly, using an (N+1)-th start pulse and setting data output by the controller, the setting data can be captured into each driver IC as shown in FIG. 6. When the self-recognizing circuit 503 in the first-stage driver IC counts N+1 start pulses, it outputs a signal to activate the data register 504. Upon receiving the activate signal, the data register 504 reads in the setting data input to the driver IC in synchronization with the clock signal and transfers the read setting data to the setting register 505. In this way, the driver IC setting can be modified. For other driver ICs, new setting data can be written to the setting register in the same manner, as is shown in FIG. 7, but the number of start pulses to be counted differs by each driver IC.

By transmitting visual data and setting data in synchronization with the start pulses in this way, the visual data consisting of data for different driver ICs can be transmitted on a common data line during one horizontal period. This driver IC chain configuration eliminates a need for using another wiring for transmitting the setting data and can reduce the number of external terminals on the driver ICs. The setting data includes, for example, the drive capacity of an amplifier to drive the display panel, the number of terminals to be driven, a gamma correction value, etc.

Figure 8:
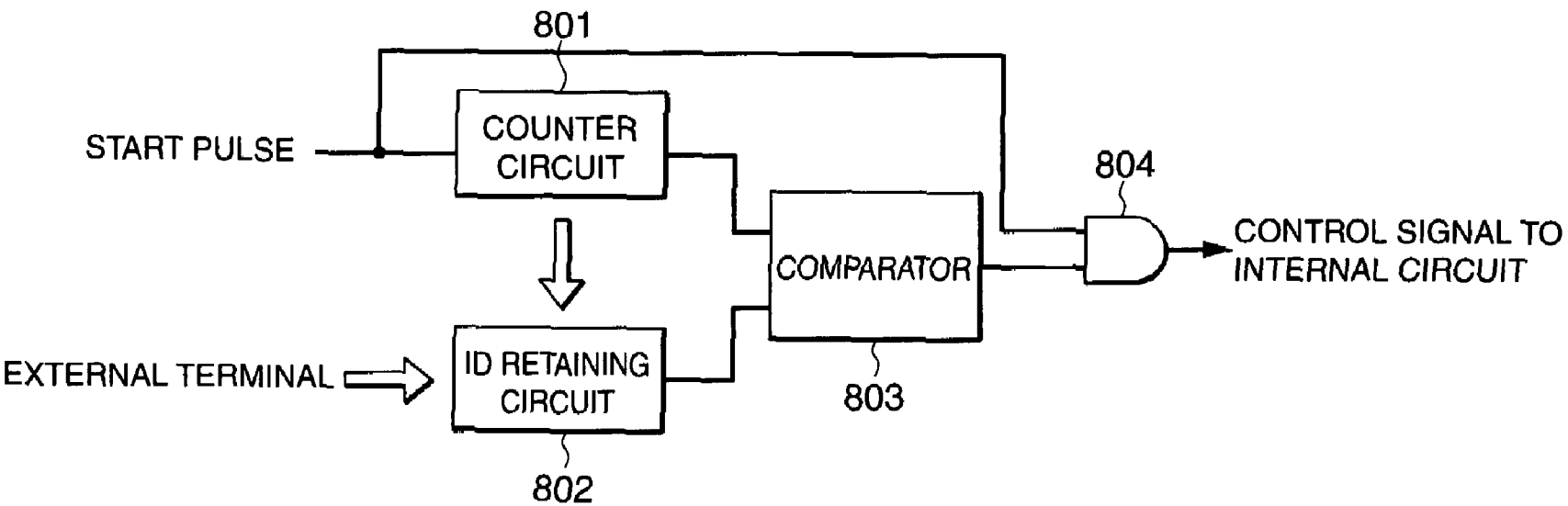
FIG. 8 is a self-recognizing circuit configuration diagram.
Figure 9:
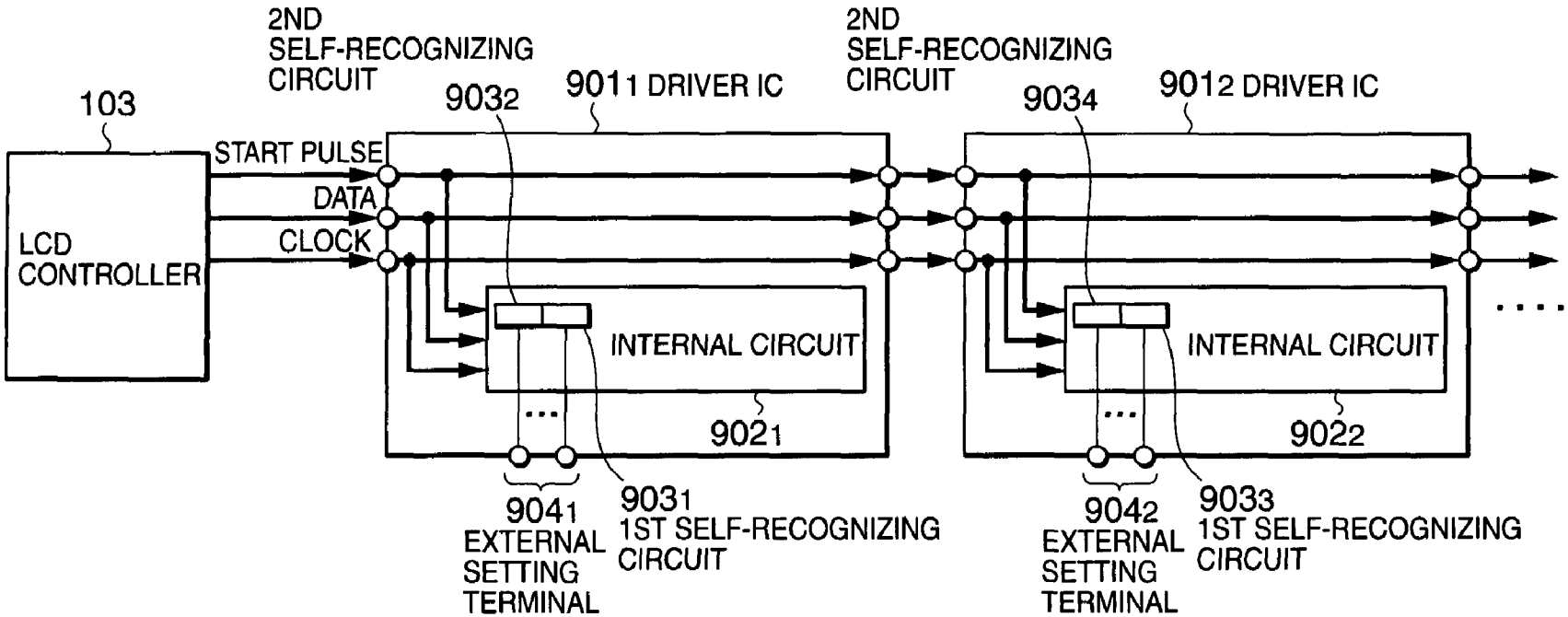
FIG. 9 is a diagram depicting Embodiment 2 of the invention.

The above self-recognizing circuit 503 for self recognition of the driver stage in the driver IC chain can be formed of, for example, a counter circuit 801, an ID retaining circuit, a comparator 803, and an AND gate 804, as is shown in FIG. 8. How the components of the self-recognizing circuit 503 operate will be briefly described below.

The counter circuit 803 counts the number of start pulses and supplies the count value to one input terminal of the comparator 803. The ID retaining circuit 802 retains an ID value which may be supplied from an external terminal or supplied through the counter circuit and supplies the ID value retained to the other input terminal of the comparator 803.

The comparator 803 compares the count value and the ID value. If the result of the comparison is a mismatch, the comparator 803 outputs a low level signal to lock the output of the AND gate 804 to a low level. If the result is a match, the comparator 803 outputs a high level signal to cause the AND gate 804 to output a start pulse.

Methods for setting an ID value held on the ID retaining circuit 802 include writing data directly from the external terminal, setting a hardware-fixed ID value for each driver IC by way of fusing, and other methods. Because using the external terminal increases the number of terminals for writing and the hardware-fixed ID setting impairs design flexibility, a setting method by which to allow for flexibility and not to increase the number of terminals is preferable.

In view hereof, through a method in which the counter circuit retains the count value of start pulses transmitted during the last horizontal period and the count value is stored into the ID retaining circuit, an ID value can be set on each ID retaining circuit without increasing the number of terminals and independent of the number of driver ICs connected in chain. Specifically, ID setting can be performed in such a way that the counter circuit of each driver IC retains the count of start pulses transmitted from the controller 103 during the last horizontal period and transfers the count value into the ID retaining circuit at the end of the horizontal period. If, for example, N pieces of driver ICs are connected, a value of N is set in the ID retaining circuit of the first-stage driver IC, a value of N−1 is set in the ID retaining circuit of the second-stage driver IC, and so on, and a value of 1 is set in the ID retaining circuit of the Nth-stage driver IC. Alternatively, ID setting can also be performed in such a way that dummy start pulses are transmitted during a blanking period, the start pulses are counted on each driver IC, and the count value is transferred into the ID retaining circuit at the end of the blanking period.

As set forth in this embodiment, input start pulses, data, and clock are transmitted through the parallel paths in the driver IC chain and one driver IC passes the remaining start pulses, data, and clock to the next driver IC. Thereby, timing misalignment between the signals can be eliminated and the reliability of the display device including the driver ICs is enhanced. Because data is sequentially transmitted through the switches in the driver ICs, all driver ICs need not be driven at a time initially. All sections of a signal line for transmitting the start pulses up to the last-stage driver IC, a data line for transmitting data, and a signal line for transmitting the clock need not be driven at a time and are arranged to be driven sequentially. Therefore, power consumption can be lowered as compared with conventional similar display devices including driver ICs connected by a prior-art method. Each driver IC is assumed including buffers for amplification, which are not shown, in the sections of the signal lines, in order to transmit the signals on the signal lines without attenuating the signals.

Next, a preferred Embodiment 2 of the present invention is discussed in detail below.

While, in Embodiment 1, each of the driver ICs includes the switch which is turned on by the activate signal from the internal circuit to allow the remaining start pulses, data, and clock to pass to the next-stage driver IC, Embodiment 2 differs from Embodiment 1 in that the internal circuit includes first and second self-recognizing circuits 9031 and 9032. Because each of the first and second self-recognizing circuits 9031 and 9032 has the same configuration as the circuitry shown in FIG. 8, these circuits will be explained, using the circuitry of FIG. 8.

In the first self-recognizing circuit 9031, the count value of start pulses counted by the counter circuit 801 and a value set in the ID retaining circuit 802 supplied from an external setting terminal are compared by the comparator 803. If the result of the comparison is a match, the internal circuit control signal is output through the AND gate 804. In response to this internal circuit control signal, the internal circuit 9021 captures the supplied data in synchronization with the clock. Therefore, a value of "1" is set in the ID retaining circuit in the first self-recognizing circuit 9031 on the first-stage driver IC to trigger capturing data upon the first start pulse and a value of "N" is set in the ID retaining circuit on the Nth-stage driver IC to trigger capturing data upon the Nth start pulse.

In the second self-recognizing circuit 9032, in the same manner as the self-recognizing circuit described in Embodiment 1, the count value of start pulses counted by the counter circuit 801 and a value set in the ID retaining circuit 802 are compared by the comparator 803 and a data register control circuit is output to the data register 504 shown in FIG. 5(B). Therefore, for example, a value of "N+1" is set in the ID retaining circuit in the second self-recognizing circuit on each driver IC to trigger capturing setting data, so that the incoming setting data can be captured simultaneously by the driver circuits upon the (N+1)-th start pulse.

As set forth above, by incorporating two self-recognizing circuits in the internal circuit, setting data can be transmitted on the data line that is used to transmit pixel data. Also, the driver ICs can share the signal line for transmitting the start pulses and the signal line for transmitting the clock. Because values can be set in the ID retaining circuits of the first and second self-recognizing circuits from the external setting terminals, the display operation can be adapted to change in the number of the driver ICs in the chain simply by changing the set values and all driver ICs can be configured uniformly with simplified design. If the set values can be fixed, fixed values can be set in the ID retaining circuits in order to reduce the number of terminals.

As is the case in Embodiment 1, in Embodiment 2 as well, input start pulses, data, and clock are transmitted through the parallel paths in the driver IC chain and one driver IC passes the remaining start pulses, data, and clock to the next driver IC. Thereby, timing misalignment between the signals can be eliminated and the reliability of the display device including the driver ICs is enhanced.

Figure 10:
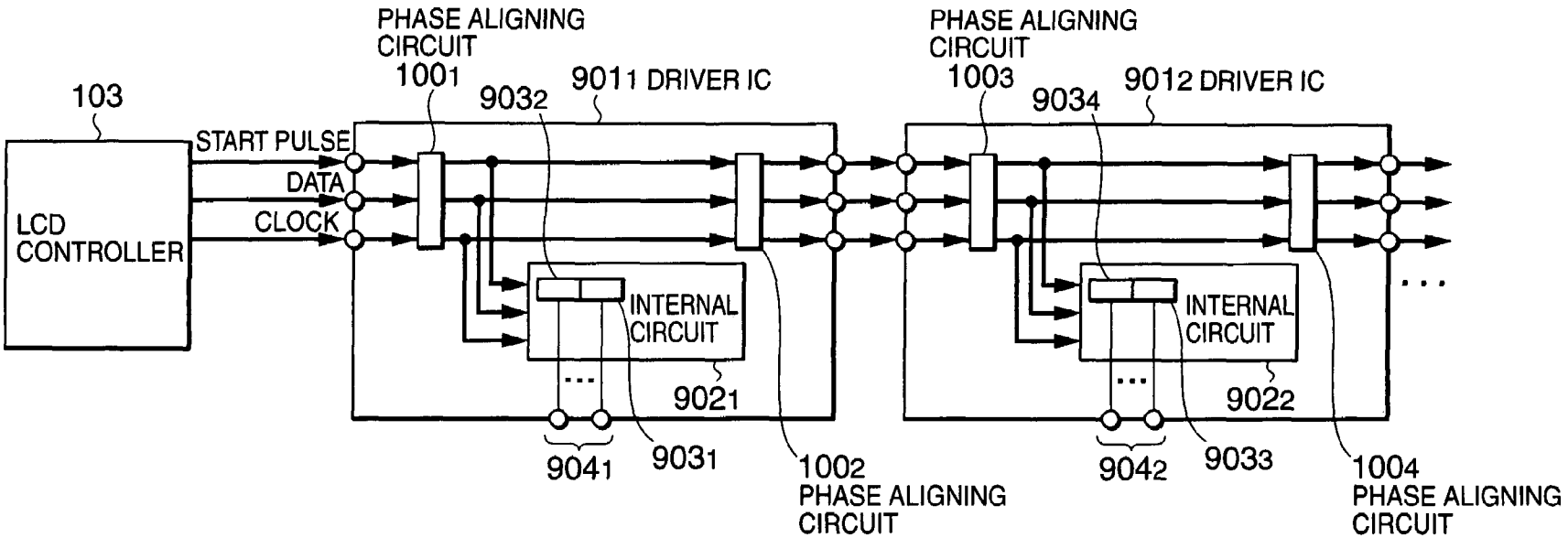
FIG. 10 is a diagram depicting an example of modification to Embodiment 2 of the present invention.
Figure 11:
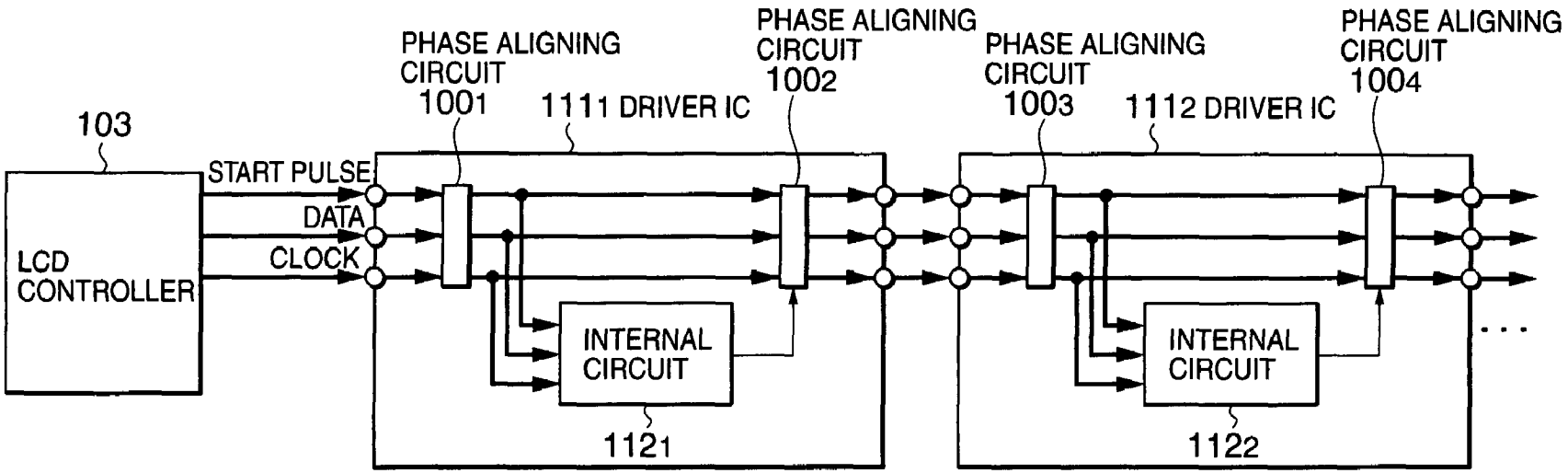
FIG. 11 is a diagram depicting an example of modification to Embodiment 1 of the present invention.
Figure 12:
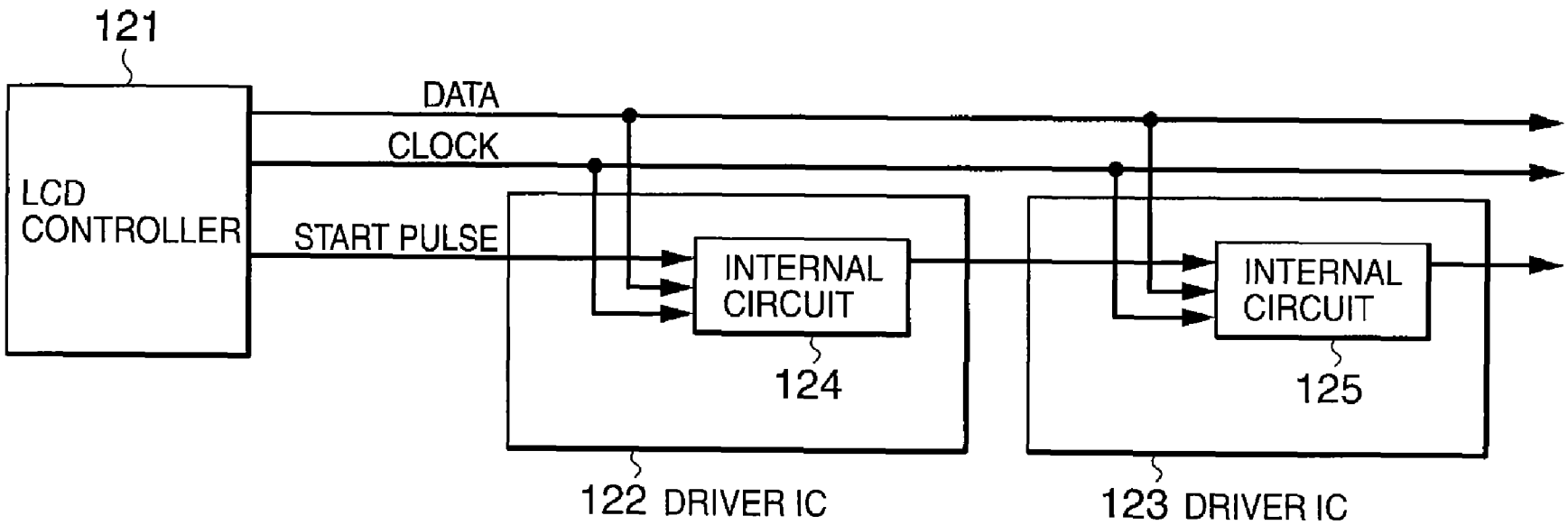
FIG. 12 PRIOR ART
FIG. 12 is a diagram depicting a prior-art display device.

Timing misalignment between the signals can be eliminated, as set forth in Embodiments 1 and 2. However, signals input from the external may fall out of sync already due to routing, resistance, capacitance, etc. of the external signal lines. Therefore, in Embodiment 2, in order to correct misalignment between the input signals, a phase aligning circuit 1001 is installed, following the input terminals of the driver IC 9011 as is shown in FIG. 10. By this phase alignment means, the reliability of data to be captured into the internal circuit 9021 can be enhanced.

By routing, resistance, and capacitance of the wiring on the driver IC 9011, the input signals may fall out of phase when coming close to the output terminals. Therefore, by installing another phase aligning circuit 1002 immediately before the output terminals, phase misalignment within the driver IC 9011 can be reduced. Therefore, the phase misalignment due to the internal wiring of the driver IC does not remain on external wiring from the output terminals of the driver IC to the next driver IC and the reliability of data to be captured to each subsequent driver IC is enhanced.

In Embodiment 1 as well, the circuitry may be modified to produce the same effect as above by installing a phase aligning circuit 1001 following the input terminals of a driver IC 1111 and installing another phase aligning circuit 1002 immediately before the output terminals. As a signal to activate the phase aligning circuit 1002, the signal to activate the switch 2031 in Embodiment 1 may be used, so that the phase aligning circuit 1002 can serve as the switch also.

While, in Embodiment 1, setting data is written through the data register into the setting register, the data register may be replaced by another means to read in setting data and write the setting data into the setting register.

While the single self-recognizing circuit or the first and second self-recognizing circuits are used for each driver IC to recognize its connection position in the driver IC chain in the described embodiments, these circuits may be replaced by another means to enable each driver IC to recognize its connection position.

While the S-R latch and the OR gate are employed to constitute the circuit outputting the internal circuit control signal in the described embodiment, these latch and gate may be replaced by another circuit that can realize the same function.

The disclosed invention can apply to all types of display devices including liquid crystal display devices, plasma display devices, and the like, provided the display device includes a controller supplying data, start pulses, and clock and a plurality of driver ICs for receiving these signals.

As set forth hereinbefore, according to the present invention, one driver IC in the driver IC chain receives clock, data, and start pulses and passes the remaining clock, data and start pulses to the next-stage driver IC without routing these signals through the internal circuit, timing misalignment between the signals can be eliminated and erroneous data capturing can be prevented.

What is claimed is:

1. A display device comprising:

a controller which outputs start pulses, data, and a clock and a plurality of drivers which are cascade connected, each of said plurality of drivers comprising a start pulse input terminal for receiving said start pulses, a data input terminal for receiving said data, a clock input terminal for receiving said clock, a start pulse output terminal for outputting said start pulses received, a data output terminal for outputting said data received, a clock output terminal for outputting said clock received, and an internal circuit which captures said data that has been input in response to one of said start pulses in synchronization with said clock, wherein each of said plurality of drivers further comprises a switch for transmitting signals to a following-stage cascade-connected driver and connects said start pulse input terminal to said start pulse output terminal, said data input terminal to said data output terminal, and said clock input terminal to said clock output terminal by a switch control signal.

2. The display device as recited in claim 1, wherein, in response to a first supplied start pulse, said internal circuit outputs the switch control signal to turn on the switch which was being off not to transmit said first supplied start pulse to a next-stage driver.

3. A display device comprising:

a controller which outputs start pulses, data, and a clock and a plurality of drivers which are cascade connected, each of said plurality of drivers comprising a start pulse input terminal for receiving said start pulses, a data input terminal for receiving said data, a clock input terminal for receiving said clock, a start pulse output terminal for outputting said start pulses received, a data output terminal for outputting said data received, a clock output terminal for outputting said clock received, and an internal circuit which captures said data that has been input in response to one of said start pulses in synchronization with said clock, wherein said start pulse input terminal is electrically connected to said start pulse output terminal by a path, said data input terminal is electrically connected to said data output terminal by a path, and said clock input terminal is electrically connected to said clock output terminal by a path, wherein these paths are not via said internal circuit, and wherein each said driver further comprises a first phase aligning circuit connected to said start pulse input terminal, said clock input terminal, and said data input terminal, and said start pulses, said clock, and said data that have been input are phase aligned through said first phase aligning circuit and then supplied to said start pulse output terminal, said clock output terminal, and said data output terminal.

4. The display device as recited in claim 3, wherein each said driver further comprises a second phase aligning circuit connected to said start pulse output terminal, said clock output terminal, and said data output terminal, and said start pulses, said clock, and said data passing through said first phase aligning circuit are phase aligned again and then supplied to said start pulse output terminal, said clock output terminal, and said data output terminal.

5. A display device comprising:

a controller which outputs start pulses, data, and a clock and a plurality of drivers which are cascade connected, each of said plurality of drivers comprising a start pulse input terminal for receiving said start pulses, a data input terminal for receiving said data, a clock input terminal for receiving said clock, a start pulse output terminal for outputting said start pulses received, a data output terminal for outputting said data received, a clock output terminal for outputting said clock received, and an internal circuit which captures said data that has been input in response to one of said start pulses in synchronization with said clock, wherein each said driver further comprises a setting register and setting data is captured through said data input terminal and written into said setting register, and wherein each said driver further comprises a self recognizing circuit and said self recognizing circuit outputs a setting data control signal at timing when a start pulse has changed to a predetermined value and permits writing of said setting data supplied from said data input terminal into said setting register.

6. A display device comprising:

a controller which outputs start pulses, data, and a clock and a plurality of drivers which are cascade connected, each of said plurality of drivers comprising a start pulse input terminal for receiving said start pulses, a data input terminal for receiving said data, a clock input terminal for receiving said clock, a start pulse output terminal for outputting said start pulses received, a data output terminal for outputting said data received, a clock output terminal for outputting said clock received, and an internal circuit which captures said data that has been input in response to one of said start pulses in synchronization with said clock, and wherein each said driver further comprises a first self recognizing circuit for capturing pixel data output from said controller and a second self recognizing circuit for capturing setting data output from said controller.

7. The display device as recited in claim 6, wherein said first self recognizing circuit permits capturing of said pixel data transmitted on a data line into the internal circuit at timing when the number of said start pulses has reached a first value and said second self recognizing circuit permits writing of said setting data transmitted on said data line into the setting register at timing when the number of said start pulses has reached a second value.

8. The display device as recited in claim 6, wherein each said driver further comprises a first phase aligning circuit connected to said start pulse input terminal, said clock input terminal, and said data input terminal, and said start pulses, said clock, and said data that have been input are phase aligned through said first phase aligning circuit and then supplied to said start pulse output terminal, said clock output terminal, and said data output terminal.

9. The display device as recited in claim 8, wherein each said driver further comprises a second phase aligning circuit connected to said start pulse output terminal, said clock output terminal, and said data output terminal, and said start pulses, said clock, and said data passing through said first phase aligning circuit are phase aligned again and then supplied to said start pulse output terminal, said clock output terminal, and said data output terminal.

* * * * *